US009354610B2

(12) United States Patent
Okeya et al.

(10) Patent No.: US 9,354,610 B2
(45) Date of Patent: May 31, 2016

(54) ANALOG ELECTRONIC TIMEPIECE

(71) Applicants: SEIKO EPSON CORPORATION, Tokyo (JP); CASIO COMPUTER CO., LTD., Shibuya-ku, Tokyo (JP)

(72) Inventors: Makoto Okeya, Nagano (JP); Katsuaki Karasawa, Hamura (JP); Hideyuki Arai, Hamura (JP)

(73) Assignees: SEIKO EPSON CORPORATION, Tokyo (JP); CASIO COMPUTER Co., Ltd., Tokyo (JP)

( * ) Notice: Subject to any disclaimer, the term of this patent is extended or adjusted under 35 U.S.C. 154(b) by 0 days.

(21) Appl. No.: 14/692,043

(22) Filed: Apr. 21, 2015

(65) Prior Publication Data

US 2015/0309477 A1 Oct. 29, 2015

(30) Foreign Application Priority Data

Apr. 23, 2014 (JP) ..... 2014-089326

(51) Int. Cl.
*G04F 8/00* (2006.01)
*G04C 3/14* (2006.01)

(52) U.S. Cl.
CPC ..... *G04F 8/006* (2013.01); *G04C 3/146* (2013.01)

(58) Field of Classification Search
CPC ..... G04C 3/146; G04F 8/006; G04F 8/00; G04F 8/02; G04B 19/046
USPC ..... 368/80
See application file for complete search history.

(56) References Cited

U.S. PATENT DOCUMENTS

| | | | | |
|---|---|---|---|---|
| 4,655,606 | A * | 4/1987 | Giger | 368/160 |
| 5,042,016 | A * | 8/1991 | Suzuki | G04C 3/007 368/185 |
| 5,214,625 | A | 5/1993 | Suzuki et al. | |
| 5,339,297 | A | 8/1994 | Suzuki et al. | |
| 7,593,292 | B2 * | 9/2009 | Blondeau et al. | 368/66 |
| 7,596,057 | B2 * | 9/2009 | Linder et al. | 368/80 |
| 8,923,096 | B1 * | 12/2014 | Stotz et al. | 368/110 |
| 2006/0280037 | A1 * | 12/2006 | Houlon | G04C 3/146 368/110 |

FOREIGN PATENT DOCUMENTS

| | | | |
|---|---|---|---|
| JP | 02-077678 | A | 3/1990 |
| JP | 2001-042062 | A | 2/2001 |
| JP | 2011-127982 | A | 6/2011 |
| JP | 2013-122390 | A | 6/2013 |
| JP | 2013-228258 | A | 11/2013 |

* cited by examiner

*Primary Examiner* — Sean Kayes
(74) *Attorney, Agent, or Firm* — Global IP Counselors, LLP

(57) ABSTRACT

An analog electronic timepiece including: a second hand; a driver configured to drive the second hand; a current time display processor configured to control the driver to move the second hand at a first time interval such that the second hand indicates a second of a current time; and a measured time display processor configured to control the driver to move the second hand at a second time interval different from the first time interval such that the second hand indicates a second of a measured time.

5 Claims, 9 Drawing Sheets

| | | TIME DISPLAY MODE | STOPWATCH MODE |
|---|---|---|---|
| SECOND-HAND STEP MOTOR | SECOND HAND | INDICATE SECOND(S) OF CURRENT TIME (MOVE EVERY MINUTE) | INDICATE SECOND(S) OF MEASURED TIME (MOVE EVERY 0.5 SECONDS) |
| HOUR/MINUTE-HAND STEP MOTOR | HOUR HAND | INDICATE HOUR(S) AND MINUTE(S) OF CURRENT TIME (MOVE EVERY MINUTE) | INDICATE HOUR(S) AND MINUTE(S) OF CURRENT TIME (MOVE EVERY MINUTE) |
| | MINUTE HAND | | |
| MODE-DISPLAY STEP MOTOR | MODE DISPLAY HAND | INDICATE MODE | INDICATE 1/20 SECONDS OF MEASURED TIME (STOP AFTER ELAPSE OF ONE MINUTE FROM MEASUREMENT START) |
| SUBHAND STEP MOTOR | FIRST SUBHAND | INDICATE HOUR(S) AND MINUTE(S) OF WORLD TIME (MOVE EVERY MINUTE) | INDICATE HOUR(S) AND MINUTE(S) OF MEASURED TIME (MOVE EVERY MINUTE) |
| | SECOND SUBHAND | | |

FIG. 3

| | | TIME DISPLAY MODE | STOPWATCH MODE |
|---|---|---|---|
| SECOND-HAND STEP MOTOR | SECOND HAND | INDICATE SECOND(S) OF CURRENT TIME (MOVE EVERY MINUTE) | INDICATE SECOND(S) OF MEASURED TIME (MOVE EVERY 0.5 SECONDS) |
| HOUR/MINUTE-HAND STEP MOTOR | HOUR HAND | INDICATE HOUR(S) AND MINUTE(S) OF CURRENT TIME (MOVE EVERY MINUTE) | INDICATE HOUR(S) AND MINUTE(S) OF CURRENT TIME (MOVE EVERY MINUTE) |
| | MINUTE HAND | | |
| MODE-DISPLAY STEP MOTOR | MODE DISPLAY HAND | INDICATE MODE | INDICATE 1/20 SECONDS OF MEASURED TIME (STOP AFTER ELAPSE OF ONE MINUTE FROM MEASUREMENT START) |
| SUBHAND STEP MOTOR | FIRST SUBHAND | INDICATE HOUR(S) AND MINUTE(S) OF WORLD TIME (MOVE EVERY MINUTE) | INDICATE HOUR(S) AND MINUTE(S) OF MEASURED TIME (MOVE EVERY MINUTE) |
| | SECOND SUBHAND | | |

ANALOG ELECTRONIC TIMEPIECE

The entire disclosure of Japanese Patent Application No. 2014-089326 filed Apr. 23, 2014 is expressly incorporated by reference herein.

BACKGROUND

1. Technical Field

The present invention relates to an analog electronic timepiece with a hand.

2. Related Art

Known typical analog electronic timepieces have time measurement functions such as a stopwatch (chronograph) function and a timer function. In some of the analog electronic timepieces, a second(s) elapsed during time measurement is indicated by a second hand for indicating the current time (see, for instance, Patent Literature 1: JP-A-2013-228258).

An analog timepiece with a chronograph function disclosed in Patent Literature 1 includes a second hand with two functions: indicating the second(s) of the current time in a normal time mode and indicating the second(s) of the measured time (chronograph second(s)) in a stopwatch mode.

However, in the analog timepiece with the chronograph function disclosed in Patent Literature 1, the second(s) of the current time (current second(s)) and the second(s) elapsed during time measurement (measured second(s)) are indicated by a single second hand, so that it is necessary to determine whether the second hand indicates the current second(s) or the measured second(s).

The analog timepiece with the chronograph function disclosed in Patent Literature 1 also includes a 1/10-second chronograph hand and/or a 1/100-second chronograph hand that are driven not in the normal time mode but in the stopwatch mode. Therefore, it can be determined whether the analog timepiece works in the normal time mode or in the stopwatch mode based on the movement of these chronograph hands (i.e., whether the second hand indicates the current second(s) or the measured second(s)).

However, as compared with the second hand, the 1/10-second chronograph hand and the 1/100-second chronograph hand move at a short hand-movement time interval and thus require a large electric power to be driven. Therefore, in order to save electric power, the chronograph hands are sometimes stopped after the elapse of a predetermined time (e.g., one minute) from the start of time measurement irrespective of whether or not the time measurement is continued. However, in the above case, it cannot be determined whether the second hand indicates the current second(s) or the measured second(s).

Alternatively, an additional hand may be provided to indicate whether the analog timepiece works in the normal time mode or in the stopwatch mode. However, when the movement range of the additional hand is small, it is difficult to clearly determine in which mode the analog timepiece works.

SUMMARY

An object of the invention is to provide an analog electronic timepiece capable of distinguishably displaying current time and measured time.

According to an aspect of the invention, an analog electronic timepiece includes: a second hand; a driver configured to drive the second hand; a current time display processor configured to control the driver to move the second hand at a first time interval such that the second hand indicates a second of a current time; and a measured time display processor configured to control the driver to move the second hand at a second time interval different from the first time interval such that the second hand indicates a second of a measured time.

In the above aspect, the second hand moves at the first time interval (e.g., one second) when indicating the second(s) of the current time (current second(s)) and moves at the second time intervals (e.g., 0.5 seconds) different from the first time interval when indicating the second(s) of the measured time (measured second(s)).

Therefore, in the above aspect, since the hand-movement time interval of the second hand for indicating the current second(s) is different from that of the second hand for indicating the measured second(s), a user can easily determine whether the second hand indicates the current second(s) or the measured second(s) based on the hand-movement time interval of the second hand.

The analog electronic timepiece can thus distinguishably display the current time and the measured time even when the single second hand is configured to indicate not only the current second(s) but also the measured second(s).

In the above aspect, it is preferable that the second time interval be shorter than the first time interval.

With the above arrangement, the second hand can indicate the measured second(s) by a small unit as compared with the current second(s). For instance, the measured second(s) may be indicated in 0.5-second increments. The measured time can thus be indicated in smaller increments.

Further, with the above arrangement, the second hand moves at a short time interval when indicating the measured second(s) as compared with when indicating the current second(s), so that a user can easily have an impression that the second hand indicates the measured second(s). The measured time can thus be distinguishably displayed.

In the above aspect, it is preferable that a step number of the second hand per 360-degree rotation be an N-multiple of 60, N being an integer of two or more, the first time interval be one second, and the second time interval be 1/N.

In the above aspect, it is preferable that the current time display processor move the second hand by N steps at the first time interval, and the measured time display processor move the second hand by one step at the second time interval.

With the above arrangement(s), the second hand moves every second when indicating the current second(s). In other words, the second hand moves at the same time interval as that of a typical timepiece driven by a step motor when indicating the current second(s), so that a user can know the current second(s) in a familiar manner.

Further, the second hand moves every second when indicating the current second(s) and moves at an interval equal to or less than half a second (i.e., 0.5 seconds) when indicating the measured second(s). Thus, a difference between the hand-movement time interval for indicating the current second(s) (i.e., one second) and the hand-movement time interval for indicating the measured second(s) (i.e., 0.5 seconds or less) can be increased to 0.5 seconds or more. Therefore, it can be more easily determined whether the second hand indicates the current second(s) or the measured second(s).

In the above aspect, it is preferable that the second hand have a rotary shaft located at a center of a dial plate of the analog electronic timepiece.

Generally, as long as the rotary shaft of a hand (a center hand) is located at the center of the dial plate, the length of the hand can be the same as a distance from the center of the dial plate to the vicinity of the periphery of the dial plate. When the second hand is configured as described above, the current second(s) and the measured second(s) can be indicated with a large motion. The current time and the measured time can thus be seen with an improved visibility.

BRIEF DESCRIPTION OF THE DRAWING(S)

The invention will be described with reference to the accompanying drawings, wherein like numbers reference like elements.

FIG. 3 shows items indicated by hands in a time display mode and in a stopwatch mode according to the exemplary embodiment.

DESCRIPTION OF EXEMPLARY EMBODIMENT(S)

An exemplary embodiment of the invention will be described below with reference to the attached drawings.

Figure 1:
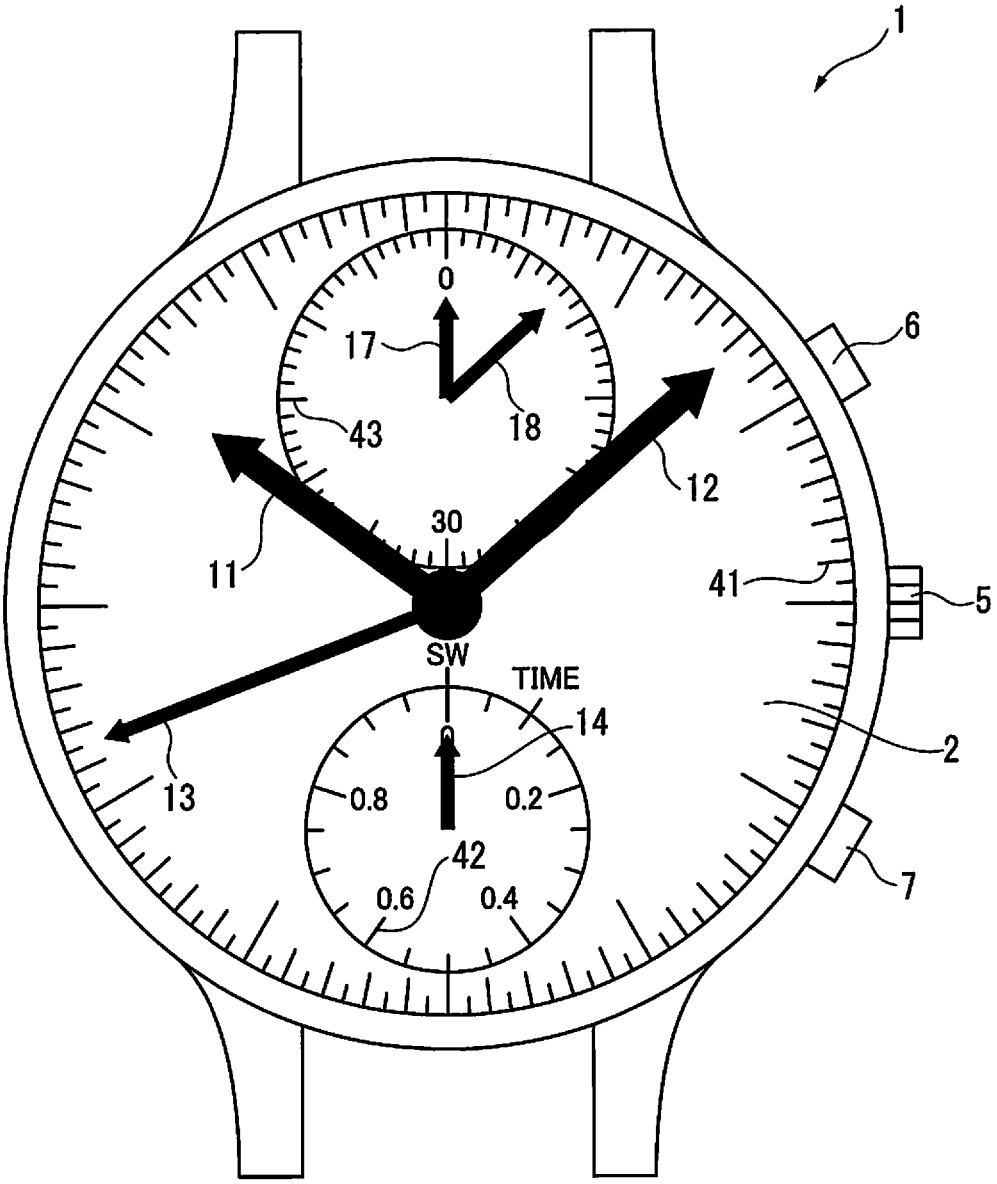
FIG. 1 is a front view showing an analog electronic timepiece according to an exemplary embodiment of the invention.

FIG. 1 is a front view showing an analog electronic timepiece 1 according to the exemplary embodiment of the invention.

As shown in FIG. 1, the analog electronic timepiece 1 includes basic timepiece hands for normal time display. Specifically, the analog electronic timepiece 1 includes an hour hand 11, a minute hand 12 and a second hand 13. The hour hand 11, the minute hand 12 and the second hand 13 each have a rotary shaft located at the center of a dial plate 2 of the analog electronic timepiece 1 in a plan view of the front of the dial plate 2. The dial plate 2 has a periphery provided with hour graduations 41 arranged to divide the circumference of the dial plate 2 into 120 sections.

The analog electronic timepiece 1 also includes a mode display hand 14 disposed at a position shifted from the center of the dial plate 2 in a 6-o'clock direction. A rotation range of the mode display hand 14 defined in the dial plate 2 has a periphery provided with 1/20-second graduations 42 arranged to divide the circumference of the rotation range into 20 sections. A sign "SW" indicating a stopwatch mode is provided at a 0-second position in the 1/20-second graduations 42. A sign "TIME" indicating a time display mode is similarly provided at a position between the 0-second position and a 0.2-second position in the 1/20-second graduations 42.

The analog electronic timepiece 1 also includes a first subhand 17 and a second subhand 18 disposed at a position shifted from the center of the dial plate 2 in a 0-o'clock direction. A rotation range of the first subhand 17 and the second subhand 18 in the dial plate 2 has a periphery provided with the minute graduations 43 arranged to divide the circumference of the rotation range into 60 sections.

The analog electronic timepiece 1 also includes external operation members including a winding crown 5, a first button 6 and a second button 7.

Figure 2:
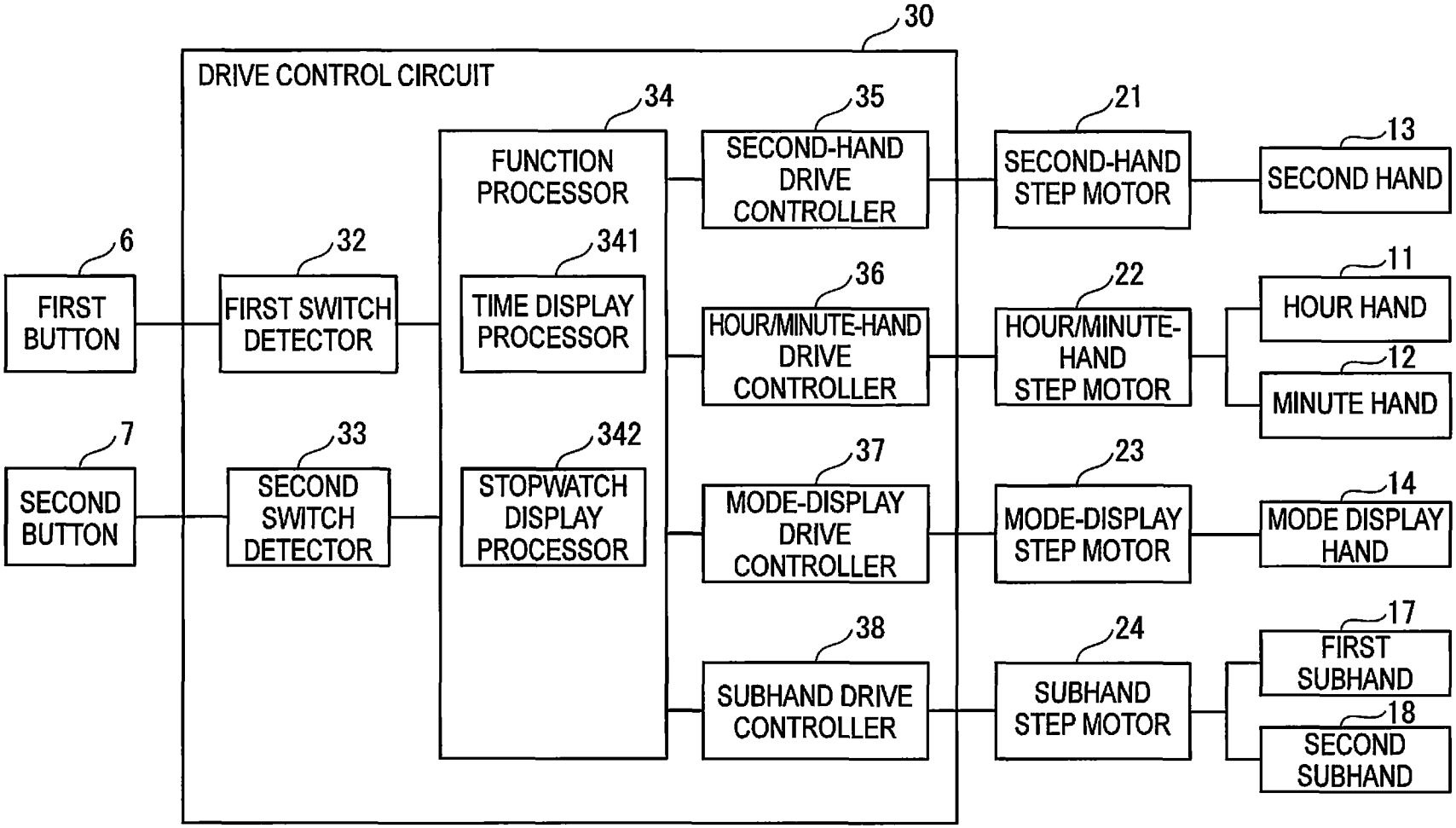
FIG. 2 is a block diagram showing an arrangement of the analog electronic timepiece.

FIG. 2 is a block diagram showing an arrangement of the analog electronic timepiece 1.

As shown in FIG. 2, the hands 11 to 14, 17 and 18 are driven by four step motors (drivers). Specifically, the second hand 13 is driven by the second-hand step motor 21, the hour hand 11 and the minute hand 12 are driven by the hour/minute-hand step motor 22, the mode display hand 14 is driven by the mode-display step motor 23, and the first subhand 17 and the second subhand 18 are driven by the subhand step motor 24.

The analog electronic timepiece 1 includes a drive control circuit 30 for controlling the drive of each of the step motors 21 to 24.

The drive control circuit 30 includes a first switch detector 32, a second switch detector 33, a function processor 34, a second-hand drive controller 35, an hour/minute-hand drive controller 36, a mode-display drive controller 37 and a subhand drive controller 38.

The first switch detector 32 detects whether or not the first button 6 is pressed and outputs a detection signal to the function processor 34 when detecting that the first button 6 is pressed.

The second switch detector 33 detects whether or not the second button 7 is pressed and outputs a detection signal to the function processor 34 when detecting that the second button 7 is pressed.

The second-hand drive controller 35 outputs a motor driving pulse based on a reference signal (e.g., a 1-Hz signal) outputted from a reference signal generating circuit including a quartz oscillator and the like to control the drive of the second hand 13 through the second-hand step motor 21.

A step number of the second hand 13 per 360-degree rotation is "120".

The hour/minute-hand drive controller 36 controls the drive of the hour hand 11 and the minute hand 12 through the hour/minute-hand step motor 22.

A step number of the minute hand 12, which is longer than the hour hand 11, per 360-degree rotation is "60". Thus, a step number of the hour hand 11, which is shorter than the minute hand 12 and driven in conjunction with the minute hand 12, per 360-degree rotation is "720".

The mode-display drive controller 37 controls the drive of the mode display hand 14 through the mode-display step motor 23. A step number of the mode display hand 14 per 360-degree rotation is "60".

The subhand drive controller 38 controls the drive of the first subhand 17 and the second subhand 18 through the subhand step motor 24. A step number of the second subhand 18, which is longer than the first subhand 17, per 360-degree rotation is "60". Thus, a step number of the first subhand 17, which is shorter than the second subhand 18 and driven in conjunction with the second subhand 18, per 360-degree rotation is "720".

The function processor 34 performs processes of various functions of the analog electronic timepiece 1. The function processor 34 includes a time display processor (a current time display processor) 341 and a stopwatch display processor (a measured time display processor) 342.

When a mode switching operation is performed with the second button 7, the function processor 34 switches a processing mode alternately between the time display mode and the stopwatch mode, and activates the processor 341 or 342 depending on the selected mode, the time display mode being selected to display the current time, the stopwatch mode (a chronograph mode) being selected to measure time elapsed from a start point Specifically, when the time display mode is selected, the function processor 34 activates the time display processor 341, whereas when the stopwatch mode is selected, the function processor 34 activates the stopwatch display processor 342.

FIG. 3 shows items indicated by the hands in the time display mode and in the stopwatch mode.

The time display processor 341, which is activated when the time display mode is selected, controls the second hand 13 through the second-hand drive controller 35 to indicate the second(s) of the current time (current second(s)).

The second hand 13 moves by two steps every second. In other words, the period of the movement of the second hand 13 is one second and the progress thereof per period is two steps. It should be noted that the hand-movement time interval of the second hand 13 in the time display mode corresponds to a first time interval according to the invention.

The time display processor 341 also controls the mode display hand 14 through the mode-display drive controller 37 to indicate the time display mode. Specifically, the mode display hand 14 is moved to point at "TIME" (indicating the time display mode) on the dial plate 2. In other words, the mode display hand 14 does not move stepwise.

The time display processor 341 controls the first subhand 17 and the second subhand 18 through the subhand drive controller 38 to indicate the hour(s) and minute(s) of world time. The first subhand 17 and the second subhand 18 move every minute. The world time is the local time of one selected from among various parts of the world. In order to set the world time, a time lag between the selected part and the present location is inputted with, for instance, the winding crown 5, the first button 6 and the second button 7.

The stopwatch display processor 342, which is activated when the stopwatch mode is selected, controls the second hand 13, the mode display hand 14, the first subhand 17 and the second subhand 18 through the second-hand drive controller 35, the mode-display drive controller 37 and the subhand drive controller 38 to perform a stopwatch operation (a chronographic operation). The stopwatch operation is performed in response to a stopwatch-start operation to rotate the hands 13, 14, 17 and 18 clockwise as time elapses to display the elapsed time on a real-time basis. The stopwatch display processor 342 thus includes an internal measurement counter that counts the reference signal(s) to measure the elapsed time.

Specifically, the stopwatch display processor 342 controls the second hand 13 through the second-hand drive controller 35 to indicate the second(s) of the measured time (measured second(s)).

The second hand 13 moves by one step every 0.5 seconds and rotates 360 degrees in one minute. In other words, the period of the movement of the second hand 13 is 0.5 seconds and the progress thereof per period is one step. The second hand 13 thus functions as a 0.5-second chronograph hand in the stopwatch mode. It should be noted that the hand-movement time interval of the second hand 13 in the stopwatch mode corresponds to a second time interval according to the invention.

The stopwatch display processor 342 also controls the mode display hand 14 through the mode-display drive controller 37 to indicate the digit of 1/20 seconds of the measured time. The mode display hand 14 moves by three steps every 1/20 seconds (0.05 seconds) and rotates 360 degrees in one second. The mode display hand 14 thus functions as a 1/20-second chronograph hand in the stopwatch mode.

The stopwatch display processor 342 stops the mode display hand 14 after the elapse of one minute from the start of the movement of the mode display hand 14. In other words, the mode display hand 14 stops at a 0-second position in the 1/20-second graduations 42. The mode display hand 14 is then set at a position corresponding to the measured time at the end of time measurement. The driven time of the mode display hand 14 can thus be reduced, thereby saving electric power required for the stopwatch operation.

The stopwatch display processor 342 controls the first subhand 17 and the second subhand 18 through the subhand drive controller 38 to indicate the hour(s) and minute(s) of the measured time. The first subhand 17 and the second subhand 18 move every minute. In other words, in the stopwatch mode, the first subhand 17 functions as a chronograph-hour hand and the second subhand 18 functions as a chronograph-minute hand.

The function processor 34 also controls the hour hand 11 and the minute hand 12 through the hour/minute-hand drive controller 36 to indicate the hour(s) and minute(s) of the current time irrespective of whether the analog electronic timepiece 1 works in the time display mode or in the stopwatch mode. The hands 11, 12 move every minute.

Mode Switching Operation

Next, a mode switching operation will be described.

Figure 4:
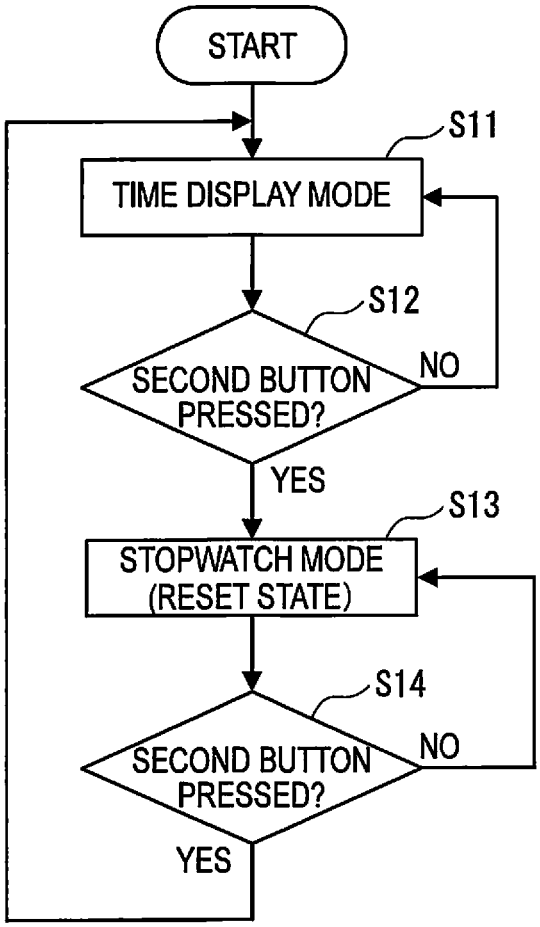
FIG. 4 is a flow chart showing a mode switching operation according to the exemplary embodiment.

FIG. 4 is a flow chart showing the process of the mode switching operation.

The process shown in FIG. 4 is started, for instance, when the function processor 34 is reset for battery replacement or the like.

The function processor 34 selects the time display mode (S11).

The function processor 34 then determines whether or not the second button 7 is pressed based on the signal outputted from the second switch detector 33 (S12).

When the determination result is NO in S12, the function processor 34 repeats the determination process of S12 while maintaining the time display mode.

When the determination result is YES in S12, the function processor 34 selects the stopwatch mode (S13).

The function processor 34 then determines whether or not the second button 7 is pressed based on the signal outputted from the second switch detector 33 (S14).

When the determination result is NO in S14, the function processor 34 repeats the determination process of S14 while maintaining the stopwatch mode.

When the determination result is YES in S14, the function processor 34 repeats the process from S11.

Stopwatch Operation

Next, the stopwatch operation will be described.

Figure 5:
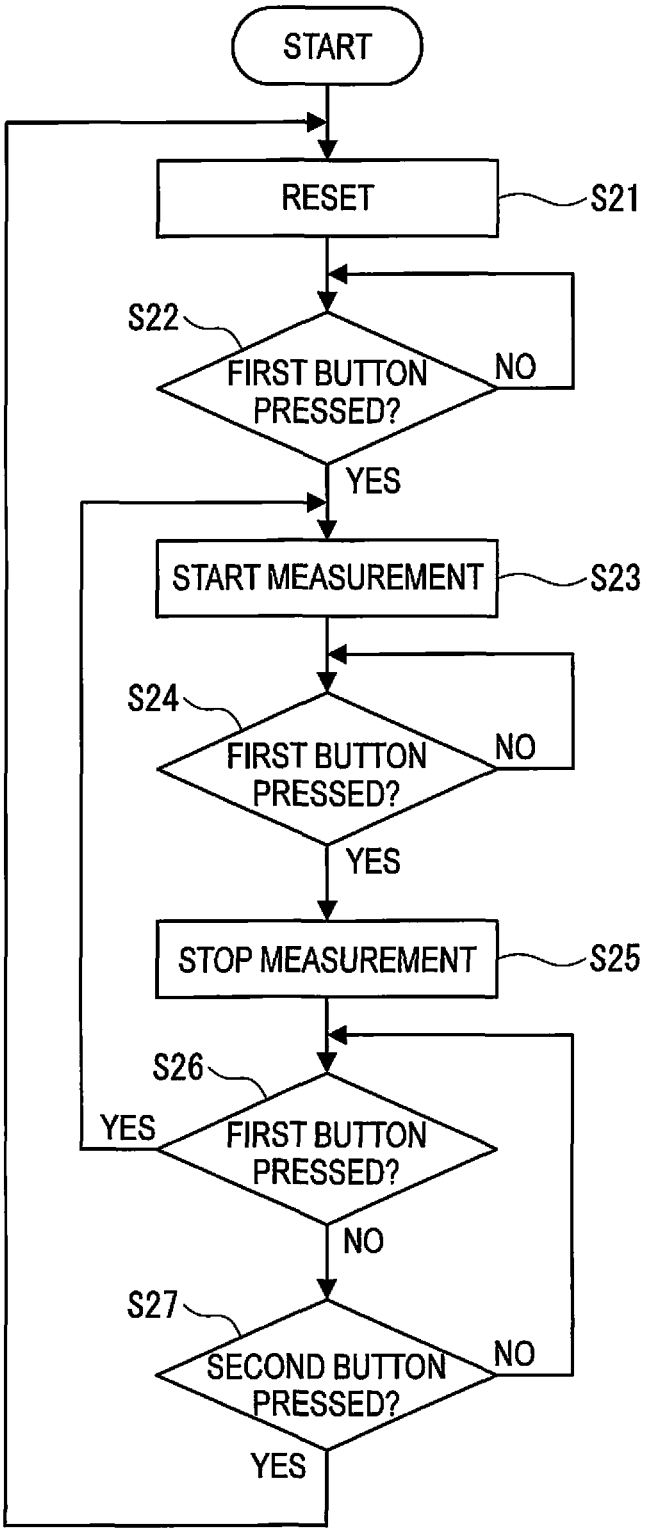
FIG. 5 is a flow chart showing a stopwatch operation according to the exemplary embodiment.

FIG. 5 is a flow chart showing the process of the stopwatch operation.

The process shown in FIG. 5 is started when the stopwatch mode is selected by the mode switching operation.

It should be noted that the time display mode is selected until the process shown in FIG. 5 is started. At this time, the hands are seen as shown in FIG. 6.

Figure 6:
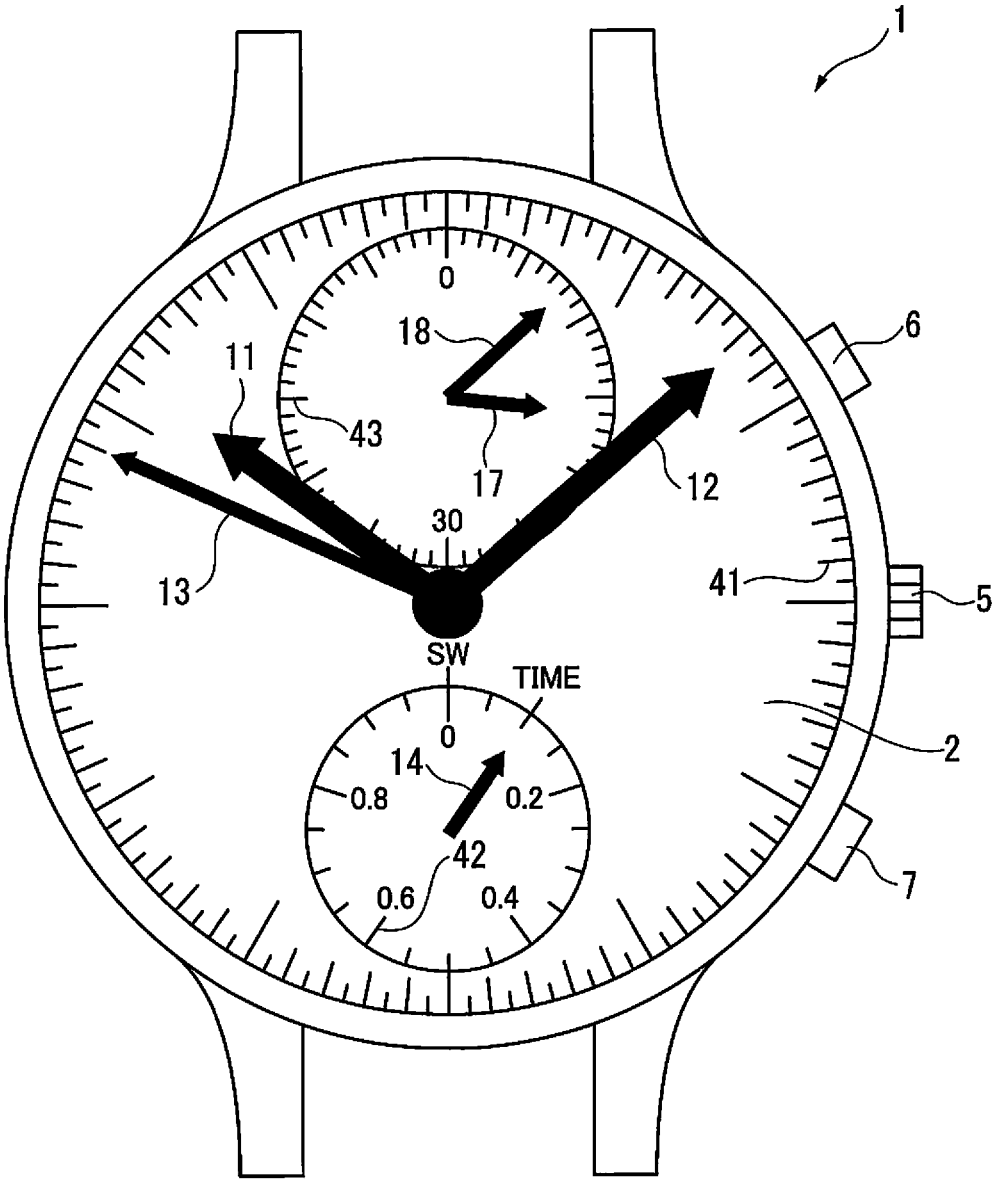
FIG. 6 shows a display example of the analog electronic timepiece in the time display mode.

Specifically, as shown in FIG. 6, the mode display hand 14 points and stays at the letters "TIME". The second hand 13, which indicates the second(s) of the current time, is moving every second. The first subhand 17 and the second subhand 18 indicate the hour(s) and minute(s) of the world time, respectively. The hour hand 11 and the minute hand 12 indicate the hour(s) and minute(s) of the current time.

When the stopwatch mode is selected by the mode switching operation, the time display processor 341 resets the inner measurement counter (S21). At this time, the hands are seen as shown in FIG. 7.

Figure 7:
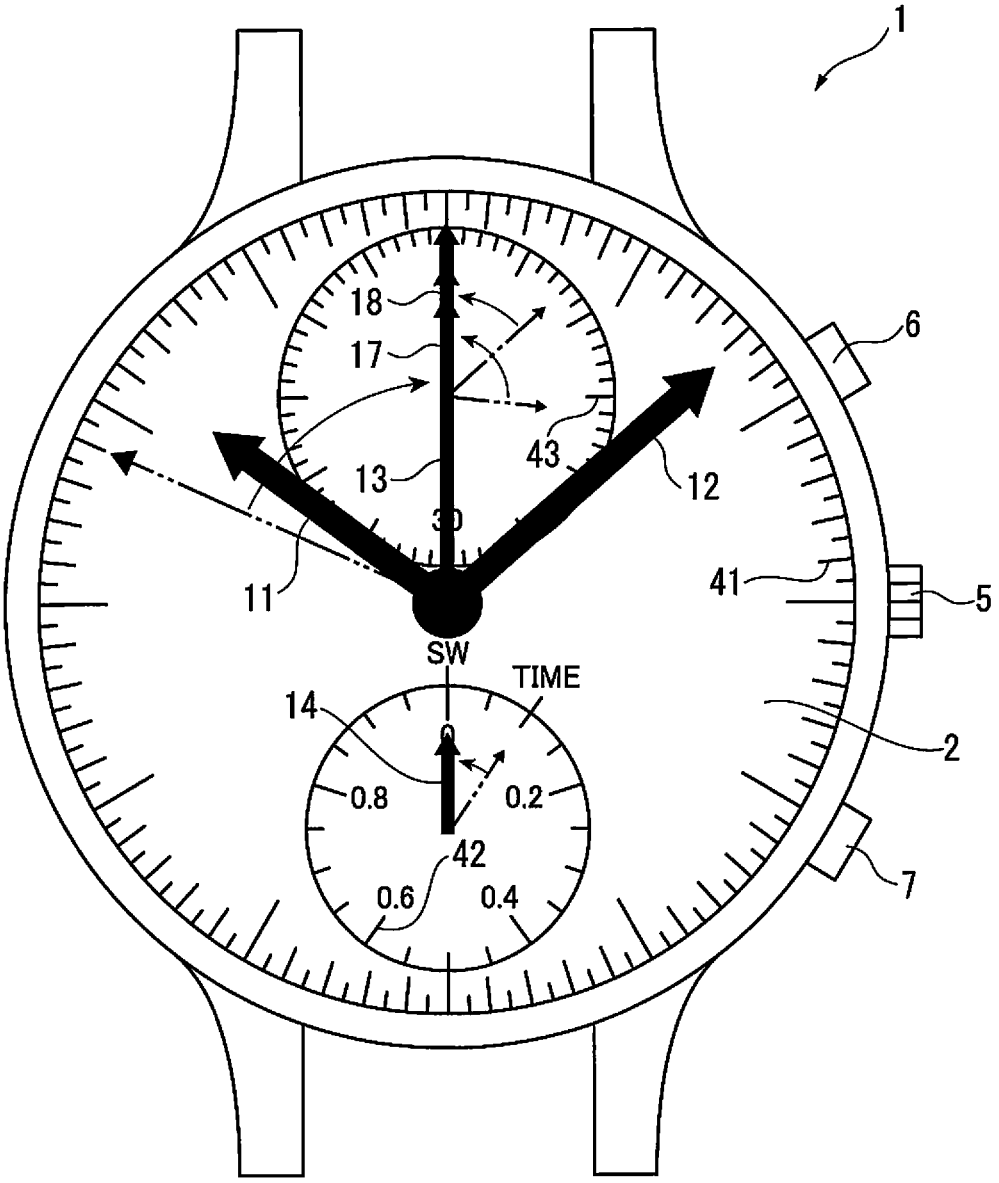
FIG. 7 shows a display example of the analog electronic timepiece seen when the analog electronic timepiece is reset in the stopwatch mode.

Specifically, as shown in FIG. 7, the mode display hand 14 is moved to point and stay at the letters "SW". The second hand 13 is moved to point and stay at the 0-second position. The first subhand 17 and the second subhand 18 are moved to point and stay at the 0-o'clock position.

The time display processor 341 then determines whether or not the first button 6 is pressed based on the signal outputted from the first switch detector 32 (S22).

When the determination result is NO in S22, the time display processor 341 repeats the determination process of S22.

When the determination result is YES in S22, the time display processor 341 starts measuring time elapsed since the first button 6 is pressed in S22 (S23).

Figure 8:
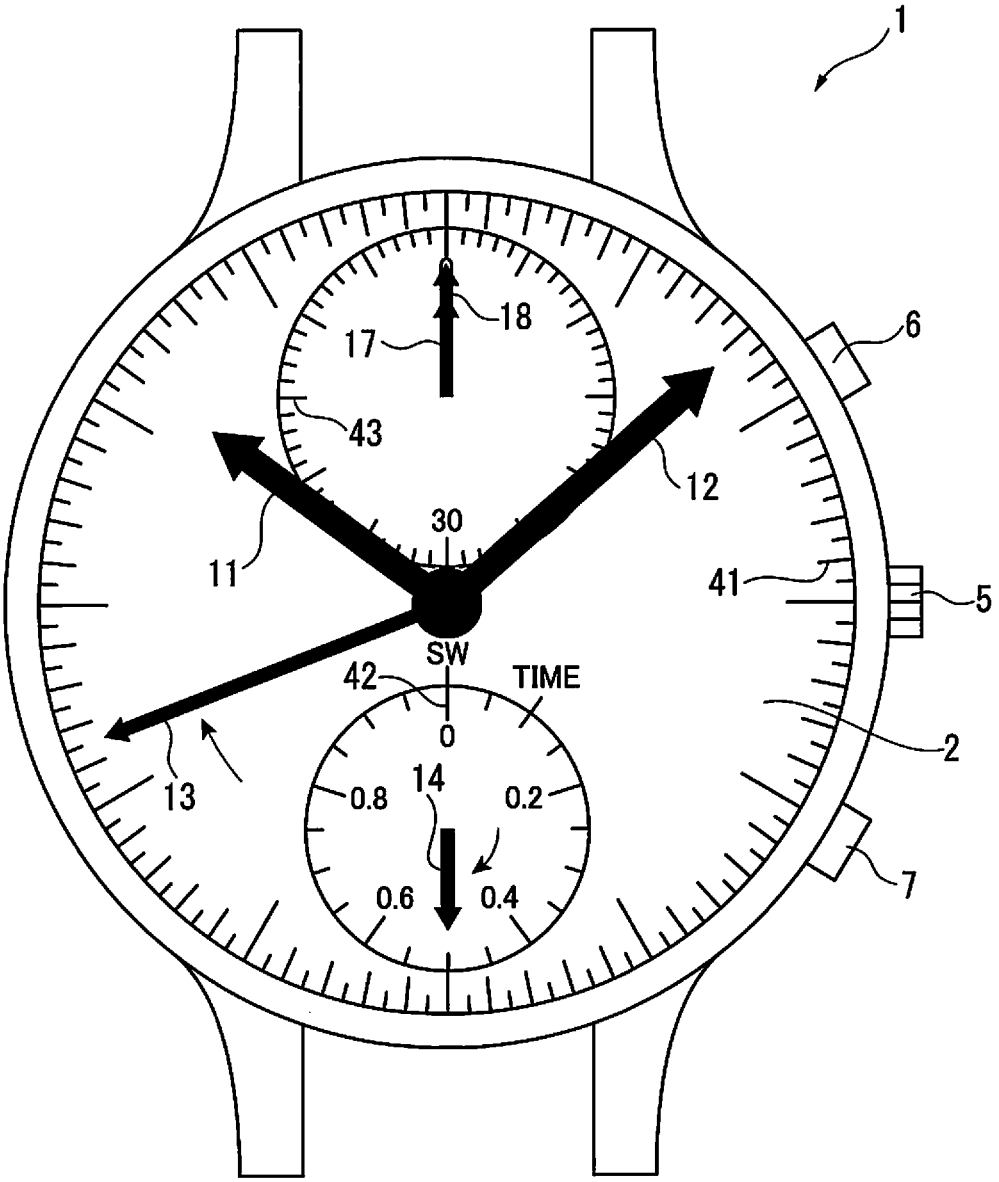
FIG. 8 shows a display example of the analog electronic timepiece seen during time measurement in the stopwatch mode.
Figure 9:
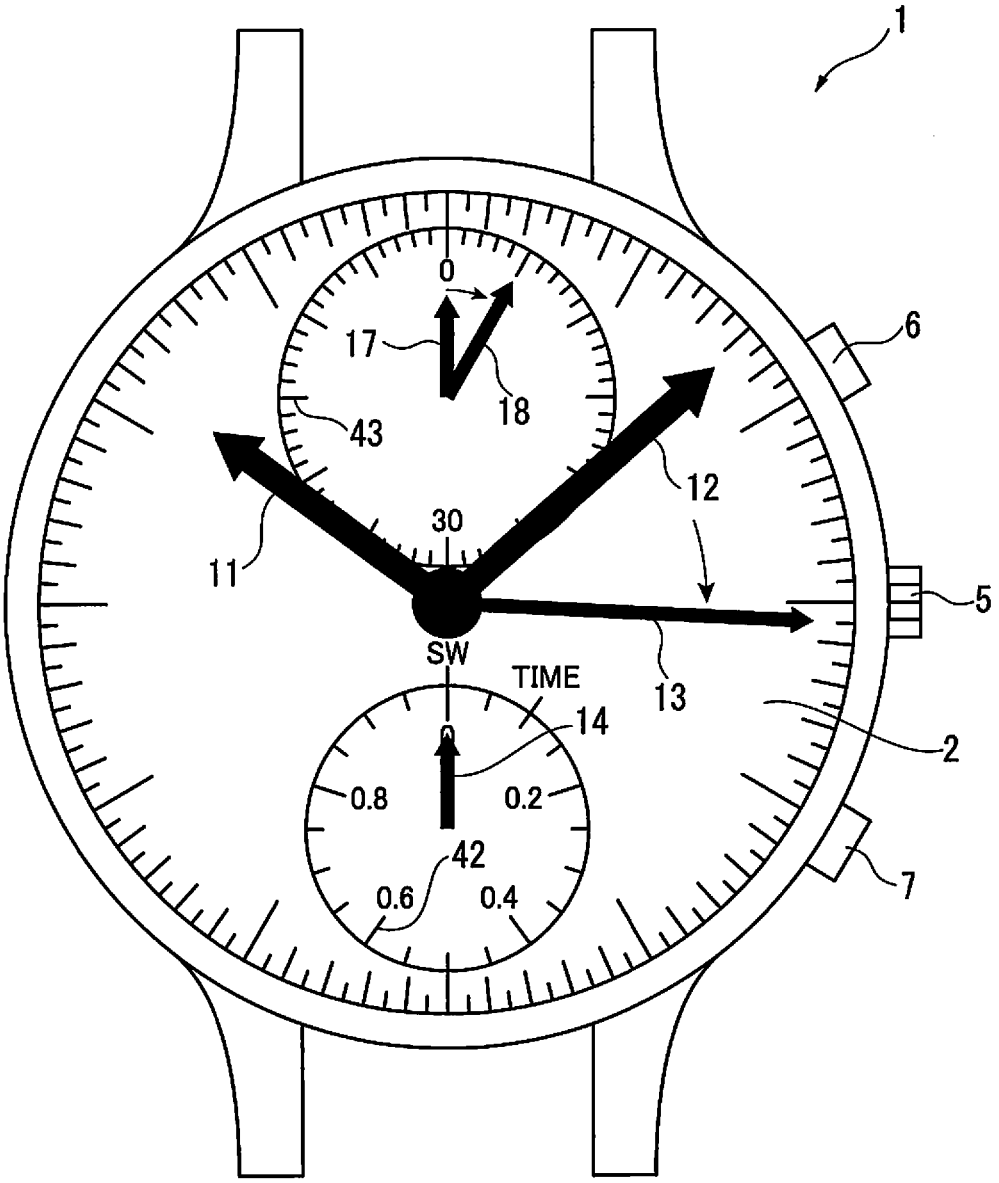
FIG. 9 shows another display example of the analog electronic timepiece seen during time measurement in the stopwatch mode.

The time display processor 341 then drives the second-hand step motor 21, the mode-display step motor 23 and the subhand step motor 24 through the second-hand drive controller 35, the mode-display drive controller 37 and the subhand drive controller 38 so that the second hand 13, the mode display hand 14, the first subhand 17 and the second subhand 18 move clockwise to indicate the elapsed time. The hands are seen as shown in FIGS. 8 and 9 during the measurement of the elapsed time.

When the measurement is started, the mode display hand 14 moves every 1/20 seconds (0.05 seconds) and the second hand 13 moves each time the mode display hand 14 points at the 0.5-second position or the 0-second position. In other words, the second hand 13 moves every 0.5 seconds. FIG. 8 shows a display example seen when the elapsed time reaches 41.5 seconds.

Each time the second hand 13 rotates 360 degrees to point at the 0-second position, the first subhand 17 and the second subhand 18 move. In other words, the first subhand 17 and the second subhand 18 move every minute. The mode display hand 14 stops at the 0-second position after the elapse of one minute since the start of the measurement. FIG. 9 shows a display example seen when the elapsed time reaches 5 minutes and 15.5 seconds.

After the process of S23, the time display processor 341 determines whether or not the first button 6 is again pressed based on the signal outputted from the first switch detector 32 (S24).

When the determination result is NO in S24, the time display processor 341 repeats the determination process of S24.

When the determination result is YES in S24, the time display processor 341 terminates the measurement of the elapsed time (S25).

Specifically, the second hand 13 indicates the second(s) of time elapsed until the first button 6 is again pressed after the first button 6 is first pressed, the mode display hand 14 indicates the digit of 1/20 seconds of the above elapsed time, and the first subhand 17 and the second subhand 18 indicate the hour(s) and minute(s) of the above elapsed time, respectively.

The stopwatch display processor 342 then determines whether or not the first button 6 is pressed based on the signal outputted from the first switch detector 32 (S26).

When the determination result is YES in S26, the stopwatch display processor 342 repeats the process from S23.

When the determination result is NO in S26, the stopwatch display processor 342 determines whether or not the second button 7 is pressed based on the signal outputted from the second switch detector 33 (S27).

When the determination result is NO in S27, the stopwatch display processor 342 repeats the process from S26.

When the determination result is YES in S27, the stopwatch display processor 342 repeats the process from S21.

Advantage(s) of Exemplary Embodiment

The second hand 13 moves every second in the time display mode and moves every 0.5 seconds in the stopwatch mode.

Therefore, since the hand-movement time interval of the second hand 13 varies between the time display mode and the stopwatch mode, a user can easily determine whether the second hand 13 indicate the current second(s) or the measured second(s) based on the hand-movement time interval.

The analog electronic timepiece 1 can thus distinguishably display the current time and the measured time even when the single second hand 13 is configured to indicate not only current second(s) but also measured second(s).

For instance, in the example of FIG. 9, the second hand 13 points at the graduation indicating 15.5 seconds. It means that the second hand 13 moves every 0.5-seconds. Therefore, it can be found that the stopwatch mode is selected in the analog electronic timepiece 1 and the second hand 13 indicates a measured second(s).

It should be noted that the hand-movement time interval of the second hand 13 in the stopwatch mode (i.e., 0.5 seconds) is shorter than that of the second hand 13 in the time display mode (i.e., one second).

The second hand 13 can thus indicate a measured second(s) in smaller increments than those of the current second(s). In the exemplary embodiment, a measured second(s) is indicated in 0.5-second increments. The measured time can thus be indicated in smaller increments.

The second hand 13 moves at a short time interval when indicating the measured second(s) as compared with when indicating the current time, so that a user can easily have an impression that the second hand 13 indicates the measured second(s). The measured time can thus be more distinguishably displayed.

The rotary shaft of the second hand 13 is located at the center of the dial plate 2.

Generally, as long as the rotary shaft of a hand (a center hand) is located at the center of the dial plate 2, the length of the hand can be the same as a distance from the center of the dial plate 2 to the vicinity of the periphery of the dial plate 2. When the second hand 13 is configured as described above, the current second(s) and the measured second(s) can be indicated with a large motion. The current time and the measured time can thus be displayed with an improved visibility.

Another Exemplary Embodiment

Incidentally, it should be noted that the scope of the invention is not limited to the above-described exemplary embodiment, but includes various modifications compatible with the invention.

For instance, in the exemplary embodiment, when the step number of the second hand 13 per 360-degree rotation is "120", the second hand 13 moves by two steps every second in the time display mode and by one step every 0.5 seconds in the stopwatch mode.

However, the invention is not limited thereto.

For instance, when the step number of the second hand 13 per 360-degree rotation may be an N-multiple of 60 (N: an integer of two or more), the second hand 13 may move by N steps every second in the time display mode and by one step every 1/N seconds.

In the above case, the second hand 13 moves every second when indicating the current second(s). In other words, the second hand 13 moves at the same hand-movement time interval as that of a typical timepiece driven by a step motor when indicating the current second(s), so that a user can know the current second(s) in a familiar manner.

In contrast, the second hand 13 moves every second when indicating the current second(s) and moves every half a second or less (i.e., 0.5 seconds or less) when indicating the measured second(s). Thus, a difference between the hand-movement time interval for indicating the current second(s) (i.e., one second) and the hand-movement time interval for indicating the measured second(s) (i.e., 0.5 seconds or less) can be increased to 0.5 seconds or more. Therefore, it can be more easily determined whether the second hand 13 indicates the current second(s) or the measured second(s).

The hand-movement time interval of the second hand 13 in the time display mode may be shorter than that of the second hand 13 in the stopwatch mode.

In the above exemplary embodiment, time measured through the stopwatch operation is referred to as the measured time, but the invention is not limited thereto. For instance, the measured time may be time measured through a timer operation in which time left after elapsed time is subtracted from preset time is measured.

In this case, the second hand 13 moves, for instance, every 0.5 seconds in a timer mode for performing the timer operation.

What is claimed is:

1. An analog electronic timepiece comprising:

an hour hand;

a minute hand;

a second hand;

a driver configured to drive the second hand;

a current time display processor configured to control the driver to move the second hand at a first time interval such that the second hand indicates a second of a current time;

a measured time display processor configured to control the driver to move the second hand at a second time interval different from the first time interval such that the second hand indicates a second of a measured time;

an hour subhand configured to indicate an hour of the current time and an hour of the measured time, a hand-movement time interval of the hour subhand to indicate the hour of the current time being equal to a hand-movement time interval of the hour subhand to indicate the hour of the measured time; and a minute subhand configured to indicate a minute of the current time and a minute of the measured time, a hand-movement time interval of the minute subhand to indicate the minute of the current time being equal to a hand-movement time interval of the minute subhand to indicate the minute of the measured time.

2. The analog electronic timepiece according to claim 1, wherein the second time interval is shorter than the first time interval.

3. The analog electronic timepiece according to claim 2, wherein a step number of the second hand per 360-degree rotation is an N-multiple of 60, N being an integer of two or more, the first time interval is one second, and the second time interval is 1/N.

4. The analog electronic timepiece according to claim 3, wherein the current time display processor moves the second hand by N steps at the first time interval, and the measured time display processor moves the second hand by one step at the second time interval.

5. The analog electronic timepiece according to claim 1, wherein the second hand has a rotary shaft located at a center of a dial plate of the analog electronic timepiece.

* * * * *